US006899013B2

(12) United States Patent
Ebbing et al.

(10) Patent No.: US 6,899,013 B2
(45) Date of Patent: May 31, 2005

(54) HINGE FOR A VARIABLE DISPLACEMENT COMPRESSOR

(75) Inventors: David Michael Ebbing, Clarence Center, NY (US); Alan L. Woodmansee, Youngstown, NY (US); Rebecca E. Bish, Buffalo, NY (US); Christopher F. Laub, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 294 days.

(21) Appl. No.: 10/354,719

(22) Filed: Jan. 30, 2003

(65) Prior Publication Data

US 2004/0149058 A1 Aug. 5, 2004

(51) Int. Cl.[7] ..... F04B 27/10
(52) U.S. Cl. ..... 92/12.2; 92/71; 74/60
(58) Field of Search ..... 92/12.2, 71; 74/60; 417/222.2

(56) References Cited

U.S. PATENT DOCUMENTS 5,947,002 A * 9/1999 Eitai et al. ..... 92/71
6,116,145 A 9/2000 Ota et al. ..... 92/12.2
6,139,283 A 10/2000 Ahn ..... 417/222.2
6,256,839 B1 7/2001 Wu
6,402,481 B1 6/2002 Ahn ..... 417/222.2
6,578,465 B2 * 6/2003 Tagami ..... 92/12.2

FOREIGN PATENT DOCUMENTS

EP 1146572 3/1969

* cited by examiner

*Primary Examiner*—Thomas E. Lazo
(74) *Attorney, Agent, or Firm*—Patrick M. Griffin

(57) ABSTRACT

The subject invention provides a pivot assembly for rotatably connecting a rotor to a swash plate in a variable displacement compressor. The rotor and swash plate each having pivot arms supporting pivot pins. A hinge is mounted to both of the pivot pins for operatively connecting the rotor to the swash plate. The hinge includes a first mounting portion receiving one of the pins and a second mounting portion receiving the other pin with a central planar region disposed between the first and second mounting portions. A tab extends from the central planar region toward each of the first and second mounting portions to engage the pins and fixedly secure the pins within their respective mounting portions. The pins therefore remain mounted to the hinge during an operation of the variable displacement compressor.

26 Claims, 3 Drawing Sheets

FIG - 1
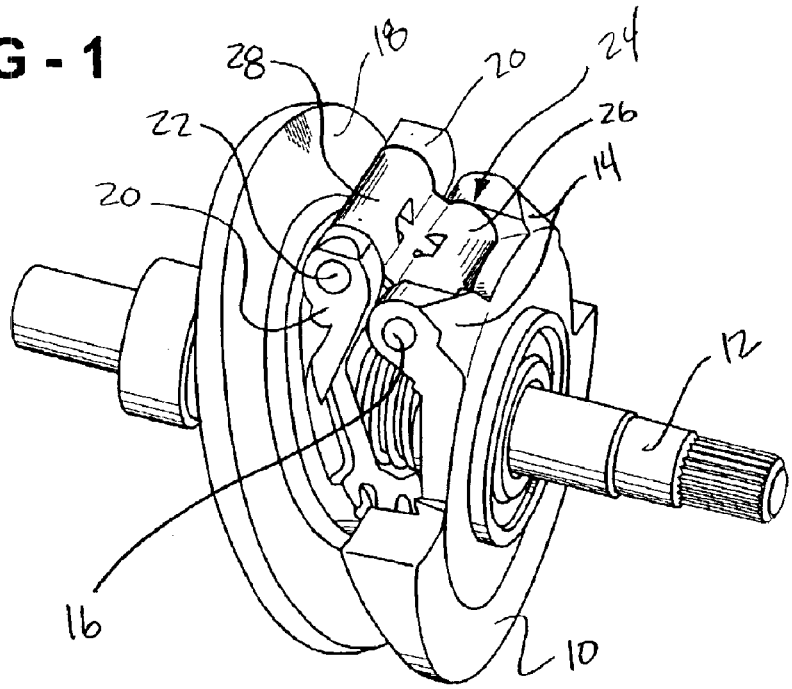
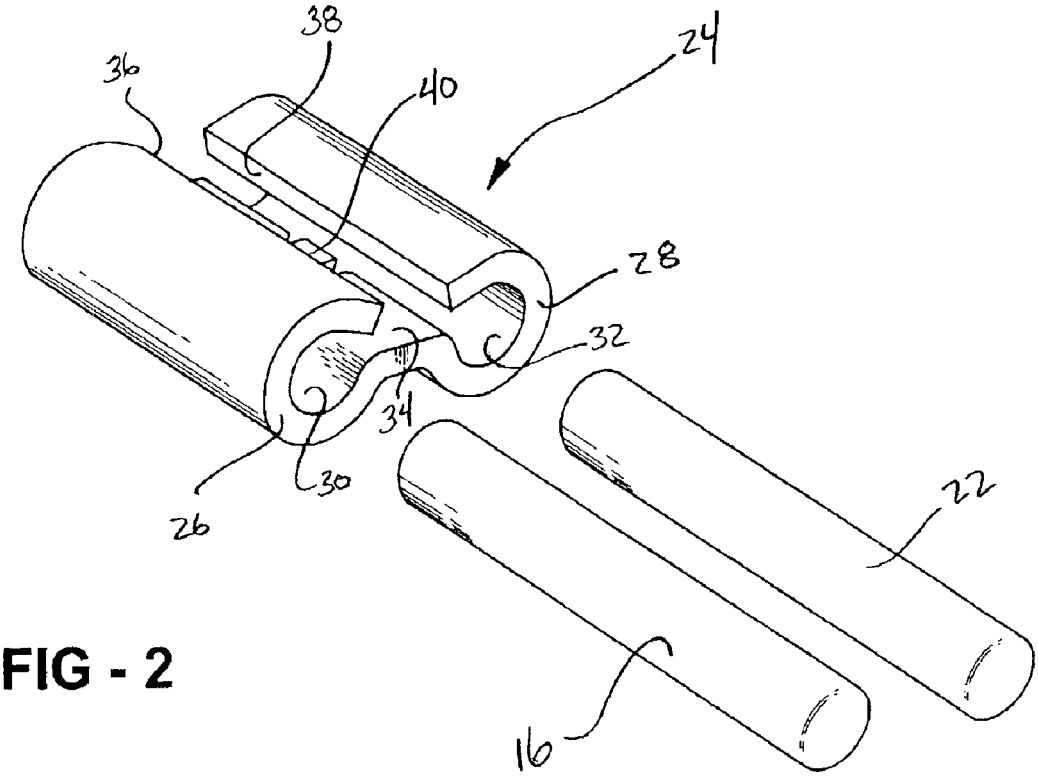
FIG - 2

HINGE FOR A VARIABLE DISPLACEMENT COMPRESSOR

BACKGROUND OF THE INVENTION

1. Field of the Invention

The subject invention relates to a variable displacement compressors and more specifically to an improved pivot assembly having a hinge for these types of compressors.

2. Description of the Prior Art

Variable displacement compressors, such as those shown in U.S. Pat. Nos. 6,139,283 and 6,402,481, are well known in the art. These types of compressors typically include a rotor secured to a drive shaft. A swash plate is slidably mounted on the drive shaft and is operatively engaged with the rotor. The engagement mechanism between the swash plate and rotor consists of one or more cylindrical pin(s) rigidly fixed to the swash plate that slidingly engage corresponding slots machined on the rotor. Alternately, other prior art designs utilize two inclined cylindrical bores that are machined features on the rotor which slidingly engage with steel (spherical) balls that extend on support posts from the swash plate. In either case, both interfaces support high forces and generate very high contact stresses; consequently the cast iron surfaces of the slots (or bores) must be heat treated for wear resistance against the hard steel pins (or sphere & post), which adds significant manufacturing cost. Furthermore, the high contact stress produces friction that resists the stroke movement of the mechanism, causing erratic controllability of compressor displacement.

In addition to the above, a hinge, having a pair of pins, may be used to pivotally engage between the swash plate and the rotor. The hinge has the advantage over the slot and pin arrangement (or bore with ball) because the sliding interface is replaced with two rotary pin connections which significantly reduces the contact stresses, allowing the joints to move freely with less frictional resistance under the same imposed loads. The hinge mechanism thus improves the controllability of the compressor displacement.

During operation of the variable displacement compressors, the hinge & pin assembly must support the compressive force generated by the pistons, and also withstand the lateral forces that react at opposite ends of the hinge, which are generated by the shaft torque pulses. These dynamic lateral side forces cause chatter across the assembly clearances on the side of the hinge interface. This vibration movement will attempt to displace the pin along its axis from the hinge; therefore, the pins must be rigidly secured to the hinge. This can be accomplished by interference fit of the pins to the mating ends of the hinge; other means include the addition of retaining rings attached to the end of the pins, to prevent movement relative the final assembly, but this method will have added cost, assembly complexity, and increased package size. Another requirement of the hinge and pin assembly is that it must low weight; the weight of the hinge and pins must be counterbalanced by added material to the swash plate and rotor, in order to minimize centrifugal forces and maintain mechanism inertial balance, which is required for high-speed stroke control stability. The prior art hinges are thus made from aluminum; an iron or steel hinge of this same geometry would be impractical to balance given the limited space and the weight restrictions imposed on the modern compact variable compressor. Typically, the pins are made from hardened steel for wear resistance against the cast iron holes on the rotor and swash plate. In addition, the aluminum hinge must possess high tensile strength to withstand the stresses caused by the interference fit pin, and the compression loads that react across the pins. The interference fit must be large enough to retain the pins at high operating temperature since the aluminum expands at twice the rate as the steel pin, which would otherwise allow the pin to vibrate loose. However, if the interference is excessive, the hinge may fracture due to the thermal contraction when the compressor is exposed to very low ambient conditions. Another consideration regarding the aluminum alloy is that it must have high silicon content for wear resistance at the lateral surfaces that engage with the mating cast iron ear surfaces of the rotor and swash plate. A final consideration is that the leading ends of the pins must be well rounded (added cost for machining/tumbling) to prevent galling/plowing of the aluminum during the press-fit assembly, which is aggravated by the high interference fit.

In summary, the prior art hinge must have precision-machined holes with very narrow tolerances, and it must be made of high strength extruded aluminum bar to withstand the press fit and remain lightweight. Also, the lateral surfaces normal to the holes must be precision machined to minimize wear at the mating cast iron rotor and swash plate ears, which also increases costs.

Accordingly, it would be desirable to provide a hinge which is relatively lightweight, inexpensive, easy to manufacture, and can withstand the stresses imparted by the compressor.

SUMMARY OF THE INVENTION AND ADVANTAGES

The subject invention provides a pivot assembly for rotatably connecting a rotor to a swash plate in a variable displacement compressor. The pivot assembly comprises a first pivot pin adapted to be rotatably mounted to the rotor. A second pivot pin is similarly adapted to be rotatably mounted to the swash plate. A hinge is mounted to both of the first and second pivot pins for operatively connecting the rotor to the swash plate. The hinge includes a first mounting portion receiving the first pin and a second mounting portion receiving the second pin with a central planar region disposed between the first and second mounting portions. A tab extends from the central planar region toward each of the first and second mounting portions to engage the first and second pins and fixedly secure the first pivot pin within the first mounting portion and the second pivot pin within the second mounting portion. The first and second pins therefore remain mounted to the hinge during an operation of the variable displacement compressor.

The subject invention also sets forth the hinge in combination with the variable displacement compressor wherein the compressor comprises a drive shaft and the rotor fixedly secured to the drive shaft such that the rotor and drive shaft rotate as a single unit. A first pair of pivot arms are mounted to the rotor and extending outwardly therefrom. The first pivot pin is rotatably disposed within the first pivot arms. The swash plate is slidably mounted on the drive shaft. A second pair of pivot arms are mounted to the swash plate and extending outwardly therefrom. The second pivot pin is rotatably disposed within the second pivot arms. The hinge is mounted to both of the first and second pivot pins to operatively connect the rotor to the swash plate. The hinge likewise includes the first mounting portion receiving the first pin and the second mounting portion receiving the second pin with the central planar region disposed between the first and second mounting portions. The tab extends from the central planar region toward each of the first and second mounting portions to engage the first and second pins and fixedly secure the first pivot pin within the first mounting portion and the second pivot pin within the second mounting portion, whereby the first and second pins remain mounted to the hinge during an operation of the variable displacement compressor.

Accordingly, the subject invention provides for a hinge constructed of thin stamped steel and having expandable open holes for the press-fit pins to provide greater dimensional interference without fracture. Furthermore, a hinge constructed of steel having similar coefficient of thermal expansion as the pin, will produce an interference fit unaffected by temperature. The subject invention is lower cost since it replaces high strength aluminum extrusion with stamped steel and eliminates precision machining operations.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of a portion of a variable displacement compressor incorporating the aspects of the subject invention;

FIG. 2 is an exploded perspective view of a pivot assembly;

DETAILED DESCRIPTION OF THE PREFERRED EMBODIMENT

Figure 3:
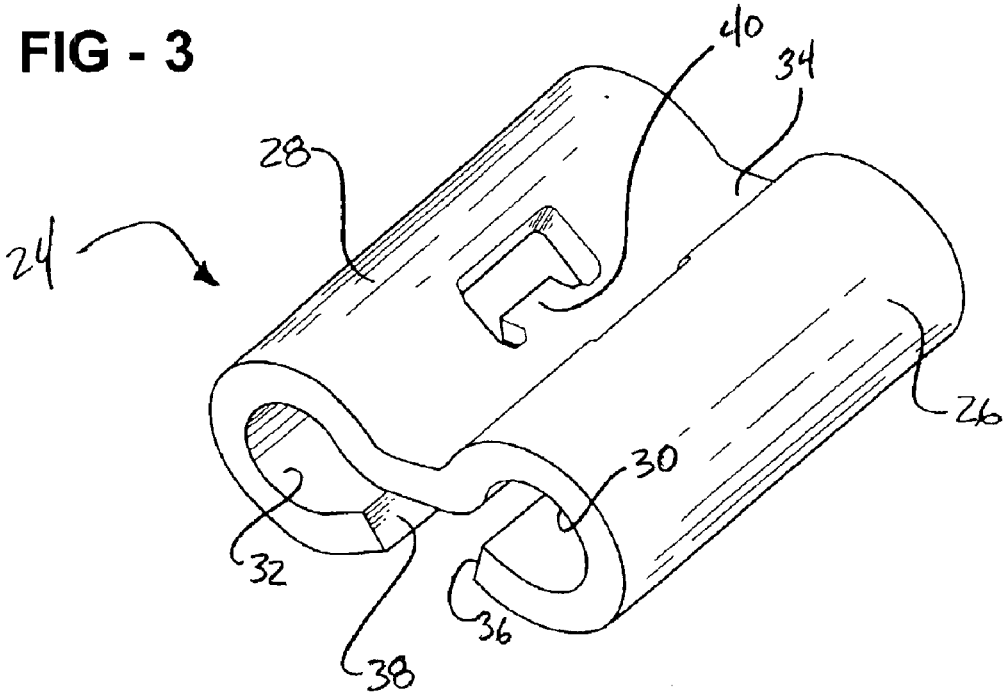
FIG. 3 is a perspective view of a hinge.

Referring to the Figures, wherein like numerals indicate like or corresponding parts throughout the several views, a portion of a variable displacement compressor is generally shown in FIG. 1. In particular, a rotor 10 is fixedly secured to a drive shaft 12 such that the rotor 10 and drive shaft 12 rotate as a single unit. A first pair of pivot arms 14 are mounted to the rotor 10 and extend outwardly therefrom. A first pivot pin 16 is rotatably disposed within the first pivot arms 14. A swash plate 18 is slidably mounted on the drive shaft 12 adjacent the rotor 10. A second pair of pivot arms 20 are mounted to the swash plate 18 and extend outwardly therefrom toward the first pair of pivot arms 14. A second pivot pin 22 is rotatably disposed within the second pivot arms 20. The first 16 and second 22 pins each preferably have a substantially annular configuration when viewed from a distal end thereof.

A hinge, generally shown at 24, is mounted to both of the first 16 and second 22 pivot pins to operatively connect the rotor 10 to the swash plate 18. The first 16 and second 22 pivot pins and the hinge 24 are also known in the subject application as a pivot assembly. The operation of the variable displacement compressor, as well as the remaining portions of the compressor, are not illustrated nor discussed in any greater detail as these features and operation are well known to those skilled in the art.

Referring also to FIGS. 2–5, a preferred embodiment of the hinge 24 is shown and described in greater detail. The hinge 24 includes a first mounting portion 26 receiving the first pin 16 and a second mounting portion 28 receiving the second pin 22. Specifically, the first mounting portion 26 includes a first inner surface 30 defining a first inner diameter and the second mounting portion 28 includes a second inner surface 32 defining a second inner diameter. The first pin 16 abuts the first inner surface 30 and the second pin 22 abuts the second inner surface 32 when the pins 16, 22 are disposed within the first 26 and second 28 mounting portions. In the preferred embodiment, the first 26 and second 28 mounting portions each have a substantially circular configuration to receive the first 16 and second 22 annular pins.

A central planar region 34 is disposed between the first 26 and second 28 mounting portions. The central planar 34 region has a length extending substantially parallel with the pins 16, 22 disposed within the first 26 and second 28 mounting portions. The first 26 and second 28 mounting portions preferably each have a substantially C-shaped configuration extending from the central planar region 34 and terminating at first 36 and second 38 distal ends, respectively. As shown in this embodiment, the first 36 and second 38 distal ends of the first 26 and second 28 C-shaped mounting portions substantially face each other. It should be appreciated that the exact configuration of the first 26 and second 28 mounting portions, as well as the central planar region 34, can be varied without deviating from the overall scope of the subject invention.

Figure 6:
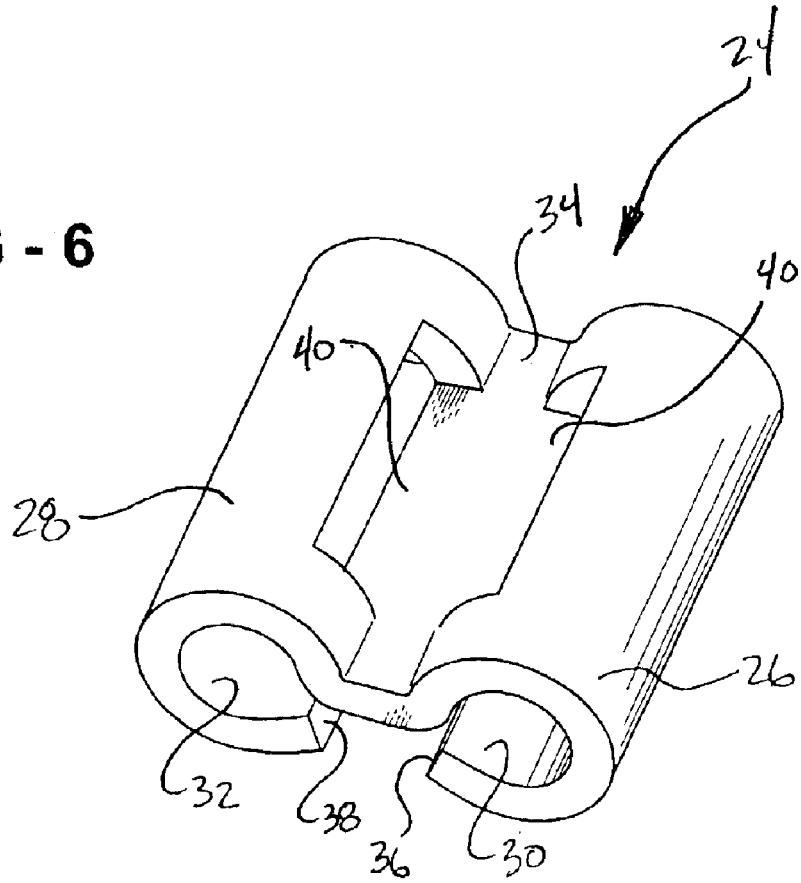
FIG. 6 is a perspective view of an alternative hinge.

A tab 40 extends from the central planar region 34 toward each of the first 26 and second 28 mounting portions to engage the first 16 and second 22 pins and fixedly secure the first pivot pin 16 within the first mounting portion 26 and the second pivot pin 22 within the second mounting portion 28. Hence, the first 16 and second 22 pins remain mounted to the hinge 24 during an operation of the variable displacement compressor. The tabs 40 are preferably aligned yet extend in opposing directions from each other into the first 26 and second 28 mounting portions. Even more preferably, the tabs 40 are positioned back to back and project into the first 26 and second 28 mounting portions along a common plane. As shown in FIGS. 1–3, the tabs 40 have a length less than half of the length of the central planar region 34. Alternatively, as shown in FIG. 6, the tabs 40 can have a length greater than half of the length of the central planar region 34.

Figure 4:
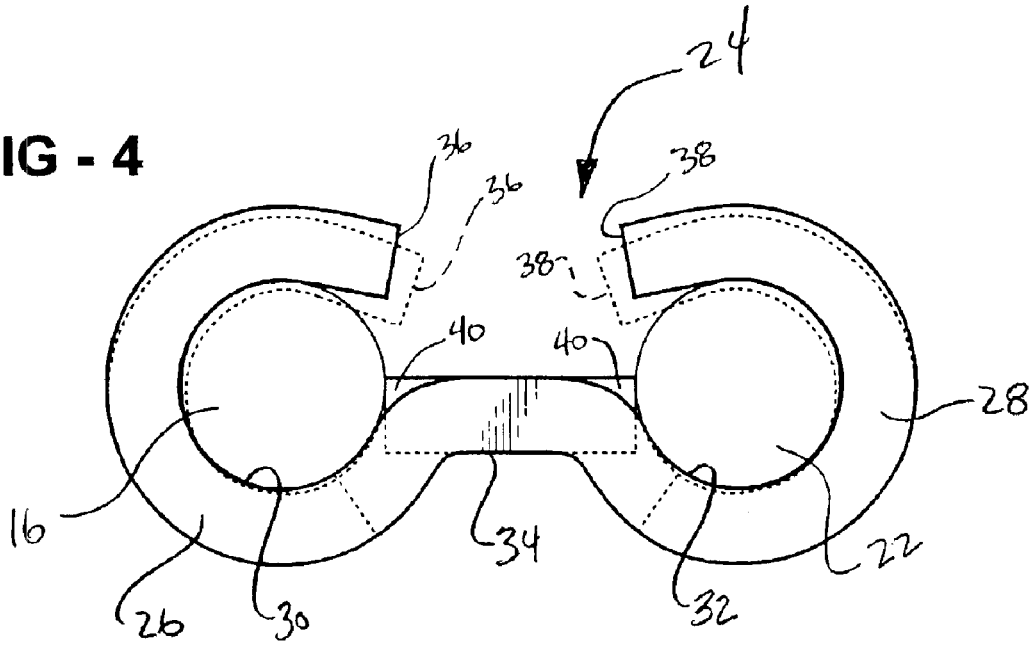
FIG. 4 is a side view of the pivot assembly.
Figure 5:
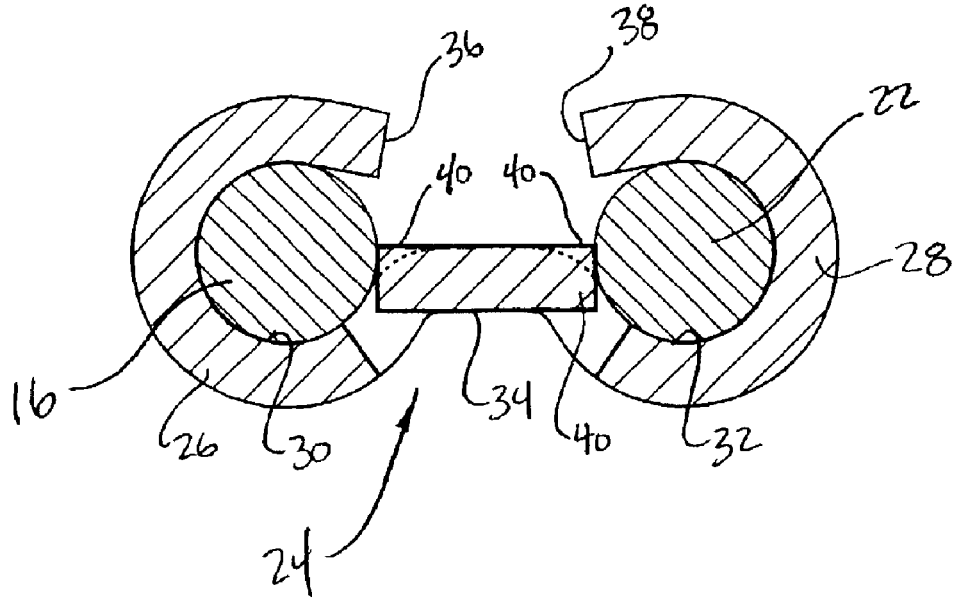
FIG. 5 is a cross-sectional view of the pivot assembly.

Preferably, the first 16 and second 22 pins are press fit into the first 26 and second 28 mounting portions. In particular, the first and second inner diameters of the mounting portions 26, 28 are smaller than a maximum outer diameter of the first 16 and second 22 pins before the first 16 and second 22 pins are press fit into the hinge 24. As best shown in FIG. 4, the first 26 and second 28 mounting portions are therefore at least partially flexible such that when the first 16 and second 22 pins are press fit into the hinge 24, the first 26 and second 28 mounting portions expand thereby increasing the first and second inner diameters. In particular, the flexible first 26 and second 28 C-shaped mounting portions move such that the first 36 and second 38 distal ends move relative to the central planar region 34 when the first 16 and second 22 pins are press fit into the hinge 24. In conjunction with the flexible C-shaped mounting portions 26, 28, the tabs 40 provide an additional mounting point for the first 16 and second 22 pins as the pins 16, 22 are press fit into the hinge 24. The tabs 40 also resist movement of the first 16 and second 22 pins toward the central planar region 34 which could expand the distal ends 36, 38 of the first 26 and second 28 mounting portions and reduce the effectiveness of the pivot assembly.

In order to facilitate the press fit arrangement, the tabs 40 are formed within the hinge 24 before the first 16 and second 22 pins are press fit into the hinge 24. In particular, the first 26 and second 28 mounting portions and the central planar region 34 of the hinge 24 are formed of a continuous piece of material, preferably steel. The continuous piece of material is first stamped and then curled to from the hinge 24 having the first 26 and second 28 mounting portions, the central planar region 34, and the tabs 40.

Preferably, the first mounting portion 26 is bent in a first rotational direction about the central planar 34 region and the second mounting portion 28 is bent in a second rotational direction about the central planar region 34 with the second rotational direction being opposite from the first rotational direction such that the hinge 24 has the two substantially C-shaped mounting portions 26, 28 facing each other. The stamping and curling of the hinge 24 is not discussed in any greater detail as this process is well known to those skilled in the art.

Of course, many modifications and variations of the present invention are possible in light of the above teachings and the invention may be practiced otherwise than as specifically described within the scope of the appended claims.

What is claimed is:

1. A variable displacement compressor comprising;

a drive shaft;

a rotor fixedly secured to said drive shaft such that said rotor and drive shaft rotate as a single unit;

a first pair of pivot arms mounted to said rotor and extending outwardly therefrom;

a first pivot pin rotatably disposed within said first pivot arms;

a swash plate slidably mounted on said drive shaft;

a second pair of pivot arms mounted to said swash plate and extending outwardly therefrom;

a second pivot pin rotatably disposed within said second pivot arms; and a hinge mounted to both of said first and second pivot pins to operatively connect said rotor to said swash plate, said hinge including a first mounting portion receiving said first pin and a second mounting portion receiving said second pin with a central planar region disposed between said first and second mounting portions and a tab extending from said central planar region toward each of said first and second mounting portions to engage said first and second pins and fixedly secure said first pivot pin within said first mounting portion and said second pivot pin within said second mounting portion, whereby said first and second pins remain mounted to said hinge during an operation of the variable displacement compressor.

2. An assembly as set forth in claim 1 wherein said first and second pins are press fit into said first and second mounting portions.

3. An assembly as set forth in claim 2 wherein said tabs are formed within said hinge before said first and second pins are press fit into said hinge.

4. An assembly as set forth in claim 2 wherein said first mounting portion includes a first inner surface defining a first inner diameter and said second mounting portion includes a second inner surface defining a second inner diameter with said first and second inner diameters of said mounting portions being smaller than a maximum outer diameter of said first and second pins before said first and second pins are press fit into said hinge.

5. An assembly as set forth in claim 4 wherein said first and second mounting portions are at least partially flexible such that when said first and second pins are press fit into said hinge, said first and second mounting portions expand thereby increasing said first and second inner diameters.

6. An assembly as set forth in claim 1 wherein said first and second mounting portions and said central planar region of said hinge are formed of a continuous piece of material.

7. An assembly as set forth in claim 6 wherein said continuous piece of material is first stamped and then curled to from said hinge having said first and second mounting portions, said central planar region, and said tabs.

8. An assembly as set forth in claim 1 wherein said first mounting portion is bent in a first rotational direction about said central planar region and said second mounting portion is bent in a second rotational direction about said central planar region with said second rotational direction being opposite from said first rotational direction such that said hinge has two substantially C-shaped mounting portions facing each other.

9. A pivot assembly for rotatably connecting a rotor to a swash plate in a variable displacement compressor, said pivot assembly comprising;

a first pivot pin adapted to be rotatably mounted to the rotor;

a second pivot pin adapted to be rotatably mounted to the swash plate; and a hinge mounted to both of said first and second pivot pins for operatively connecting the rotor to the swash plate, said hinge including a first mounting portion receiving said first pin and a second mounting portion receiving said second pin with a central planar region disposed between said first and second mounting portions and a tab extending from said central planar region toward each of said first and second mounting portions to engage said first and second pins and fixedly secure said first pivot pin within said first mounting portion and said second pivot pin within said second mounting portion, whereby said first and second pins remain mounted to said hinge during an operation of the variable displacement compressor.

10. An assembly as set forth in claim 9 wherein said first and second pins are press fit into said first and second mounting portions.

11. An assembly as set forth in claim 10 wherein said tabs are formed within said hinge before said first and second pins are press fit into said hinge.

12. An assembly as set forth in claim 11 wherein said tabs extend in opposing directions from each other into said first and second mounting portions.

13. An assembly as set forth in claim 10 wherein said first mounting portion includes a first inner surface defining a first inner diameter and said second mounting portion includes a second inner surface defining a second inner diameter with said first and second inner diameters of said mounting portions being smaller than a maximum outer diameter of said first and second pins before said first and second pins are press fit into said hinge.

14. An assembly as set forth in claim 13 wherein said first and second mounting portions are at least partially flexible such that when said first and second pins are press fit into said hinge, said first and second mounting portions expand thereby increasing said first and second inner diameters.

15. An assembly as set forth in claim 9 wherein said first and second pins each have a substantially annular configuration when viewed from a distal end thereof.

16. An assembly as set forth in claim 15 wherein said first and second mounting portions each have a substantially circular configuration to receive said first and second annular pins.

17. An assembly as set forth in claim 15 wherein said first and second mounting portions each have a substantially C-shaped configuration extending from said central planar region and terminating at first and second distal ends, respectively.

18. An assembly as set forth in claim 17 wherein said first and second C-shaped mounting portions are at least partially flexible such that said first and second distal ends move relative to said central planar region when said first and second pins are press fit into said hinge.

19. An assembly as set forth in claim 18 wherein said first and second distal ends of said first and second C-shaped mounting portions substantially face each other.

20. An assembly as set forth in claim 9 wherein said first and second mounting portions and said central planar region of said hinge are formed of a continuous piece of material.

21. An assembly as set forth in claim 20 wherein said continuous piece of material is further defined as steel.

22. An assembly as set forth in claim 20 wherein said continuous piece of material is first stamped and then curled to from said hinge having said first and second mounting portions, said central planar region, and said tabs.

23. An assembly as set forth in claim 9 wherein said first mounting portion is bent in a first rotational direction about said central planar region and said second mounting portion is bent in a second rotational direction about said central planar region with said second rotational direction being opposite from said first rotational direction such that said hinge has two substantially C-shaped mounting portions facing each other.

24. An assembly as set forth in claim 9 wherein said central planar region has a length extending substantially parallel with said pins disposed within said first and second mounting portions.

25. An assembly as set forth in claim 24 wherein said tabs have a length less than half of said length of said central planar region.

26. An assembly as set forth in claim 24 wherein said tabs have a length greater than half of said length of said central planar region.

* * * * *